US008820992B2

(12) United States Patent
Wilson et al.

(10) Patent No.: US 8,820,992 B2
(45) Date of Patent: Sep. 2, 2014

(54) AUTOMOTIVE HEADLAMP ASSEMBLY

(75) Inventors: Terrence J. Wilson, Melvindale, MI (US); Stephen K. Helwig, Farmington Hills, MI (US); Sleiman N. Abdelnour, Macomb, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 108 days.

(21) Appl. No.: 13/478,193

(22) Filed: May 23, 2012

(65) Prior Publication Data

US 2013/0314946 A1 Nov. 28, 2013

(51) Int. Cl.
*F21V 9/00* (2006.01)
*F21S 8/10* (2006.01)

(52) U.S. Cl.
CPC ..... *F21S 48/1241* (2013.01)
USPC ..... 362/511; 362/612; 362/545

(58) Field of Classification Search
CPC ..... F21S 48/1388; F21S 48/1208
USPC ..... 362/612, 507, 509, 511
See application file for complete search history.

(56) References Cited

U.S. PATENT DOCUMENTS

| | | | | |
|---|---|---|---|---|
| D428,659 | S * | 7/2000 | Sonderegger et al. | D26/24 |
| 7,163,327 | B2 | 1/2007 | Henson et al. | |
| 7,560,742 | B2 | 7/2009 | Wilson et al. | |
| 7,760,403 | B2 * | 7/2010 | Sakurai | 358/484 |
| 2007/0127251 | A1 * | 6/2007 | Oyama | 362/459 |
| 2008/0013333 | A1 * | 1/2008 | Koizumi et al. | 362/511 |
| 2008/0062712 | A1 | 3/2008 | Woodward | |
| 2011/0228549 | A1 | 9/2011 | Lindsay et al. | |
| 2012/0250343 | A1 * | 10/2012 | Koizumi | 362/511 |

* cited by examiner

*Primary Examiner* — Diane Lee
*Assistant Examiner* — Gerald J Sufleta, II
(74) *Attorney, Agent, or Firm* — Jason Rogers; MacMillan, Sobanski & Todd, LLC

(57) ABSTRACT

A headlamp assembly includes a bezel defining a first surface and a second surface inclined with respect to the first surface and located at an outboard periphery, a series of fingers separated by slots, each slot extending through the first surface and the second surface, light sources, and light guides, each light guide fitted into one of the slots, for transmitting light from one of the light sources, along and through one of the slots.

14 Claims, 4 Drawing Sheets

AUTOMOTIVE HEADLAMP ASSEMBLY

BACKGROUND OF THE INVENTION

This invention relates generally to a headlamp for a motor vehicle, the headlamp incorporating unique accent lighting and a bezel assembly configuration.

SUMMARY OF THE INVENTION

A headlamp assembly includes a bezel defining a first surface and a second surface inclined with respect to the first surface and located at an outboard periphery, a series of fingers separated by slots, each slot extending through the first surface and the second surface, light sources, and light guides, each light guide fitted into one of the slots, for transmitting light from one of the light sources, along and through one of the slots.

The headlamp assembly includes no cut-outs in the bezel for allowing light to bleed through, thereby preventing the light source being visible in a non-light condition and providing a jewel-crystal look having a clear lens.

The headlamp assembly includes no black and clear co-mold design, thereby helping to achieve the jewel-crystal look and avoiding absorption of light by the black portion. Consequently the assembly provides a uniform distribution of light.

The scope of applicability of the preferred embodiment will become apparent from the following detailed description, claims and drawings. It should be understood, that the description and specific examples, although indicating preferred embodiments of the invention, are given by way of illustration only. Various changes and modifications to the described embodiments and examples will become apparent to those skilled in the art.

DESCRIPTION OF THE DRAWINGS

The invention will be more readily understood by reference to the following description, taken with the accompanying drawings, in which.

DESCRIPTION OF THE PREFERRED EMBODIMENT

Figure 1:
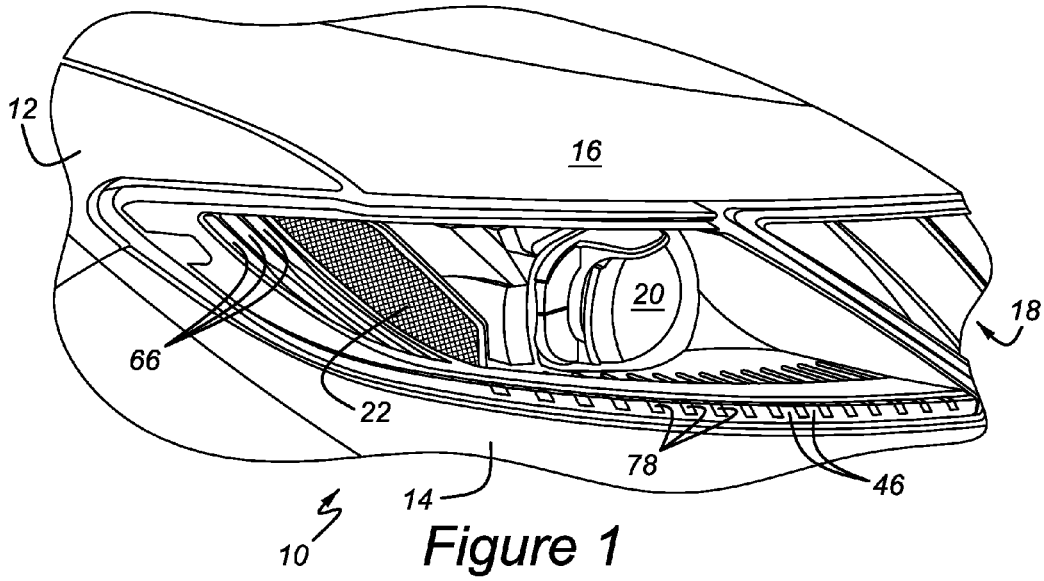
FIG. 1 is a perspective side view of an automotive a headlamp assembly installed in a motor vehicle.
Figure 2:
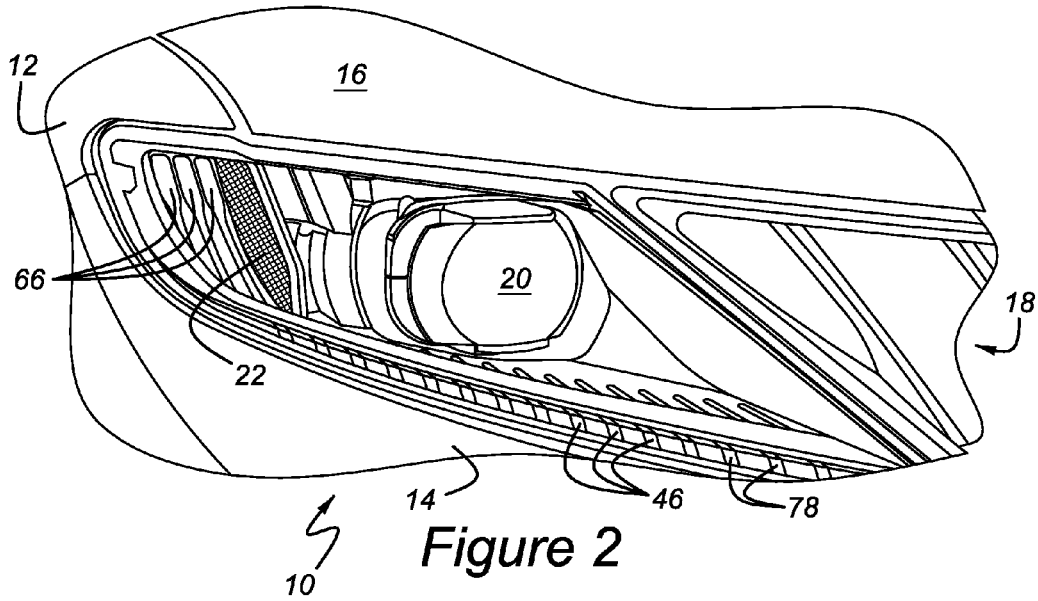
FIG. 2 is a perspective view of the automotive a headlamp assembly installed in a motor vehicle.

FIGS. 1 and 2 are perspective views of an automotive headlamp assembly 10 installed in a motor vehicle showing the vehicle's side panel 12, fascia 14, hood 16, grille 18, projector module 20, side reflex 22, and light guides 62, 66. The projector module 20 is the primary source of light produced by the headlamp assembly 10. The side reflex is a yellow colored surface with reflex pins on the B-side that provides reflectivity when light is shone against it.

Figure 3:
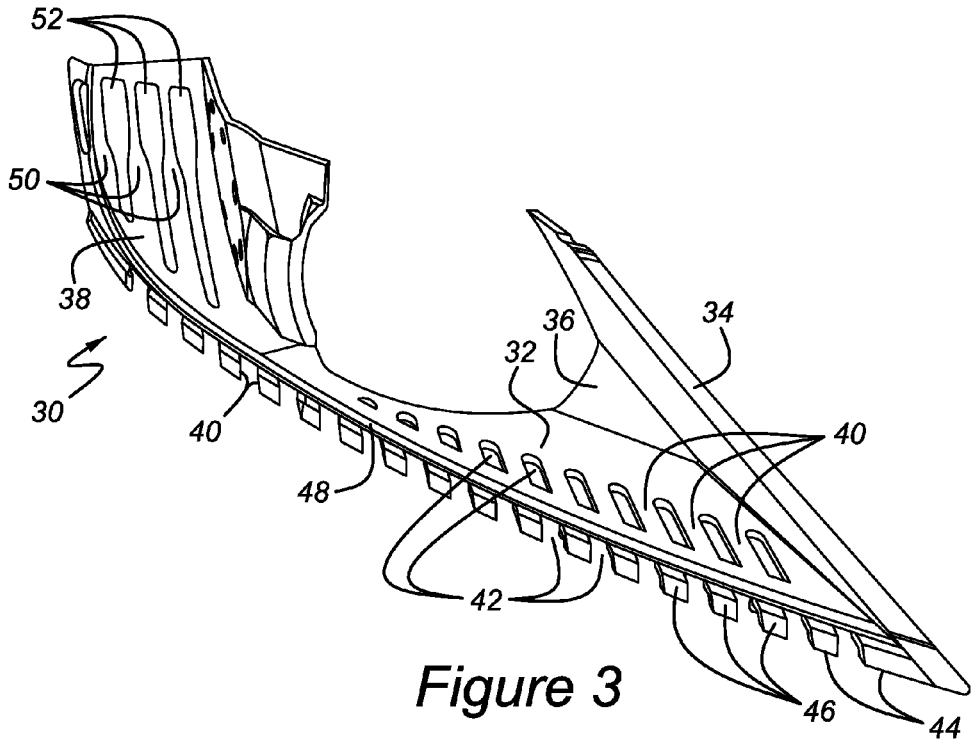
FIG. 3 is a perspective view of a bezel for the headlamp assembly of FIGS. 1 and 2.

FIG. 3 is a perspective view of the headlamp assembly's bezel 30, which is preferably formed of molded plastic. The bezel 30 includes a first surface 32; an inboard wall 34; a transition surface 36, extending between first surface 32 and inboard wall 34; and a third surface 38, inclined upward and rearward with respect to first surface 32.

First surface 32 is formed with a series of first fingers 40 separated by slots 42, each slot 42 extending through a thickness of first surface 32 and extending to an outboard periphery 44 of the bezel 30. Preferably the tip of each finger 40 at the outer periphery 44 terminates at a second surface 46, which is inclined downward and forward with respect to first surface 32. An outboard stiffener 48, interconnecting the fingers 40, provides structural continuity between the fingers 40 and stability to the bezel assembly 30.

Third surface 38 is formed with a series of second fingers 50 separated by third slots 52, each third slot 52 extending through a thickness of third surface 38 and along a length of third surface 38. Due to the inclination of third surface 38 relative to first surface 32, third slots 52 also extend rearward and upward.

Figure 4:
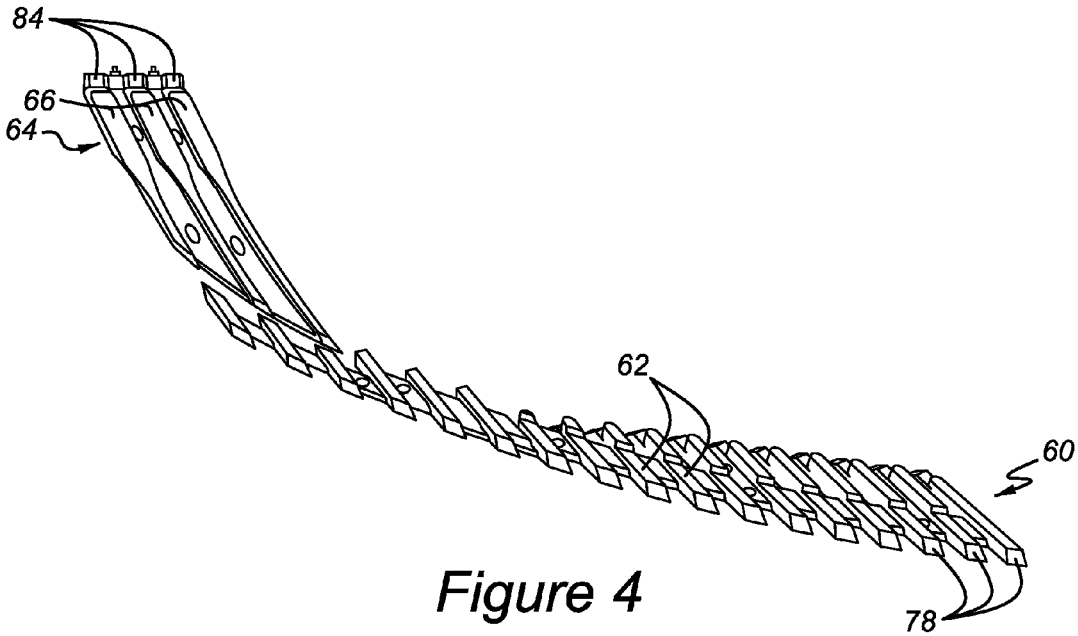
FIG. 4 is a perspective view of light guides for the headlamp assembly of FIGS. 1 and 2.

FIG. 4 shows an assembly 60 of light guides 62, each light guide 62 able to fit into one of the first slots 42.

FIG. 4 also shows an assembly 64 of second light guides 66, each second light guide 66 able to fit into one of the second slots 52.

Figure 5:
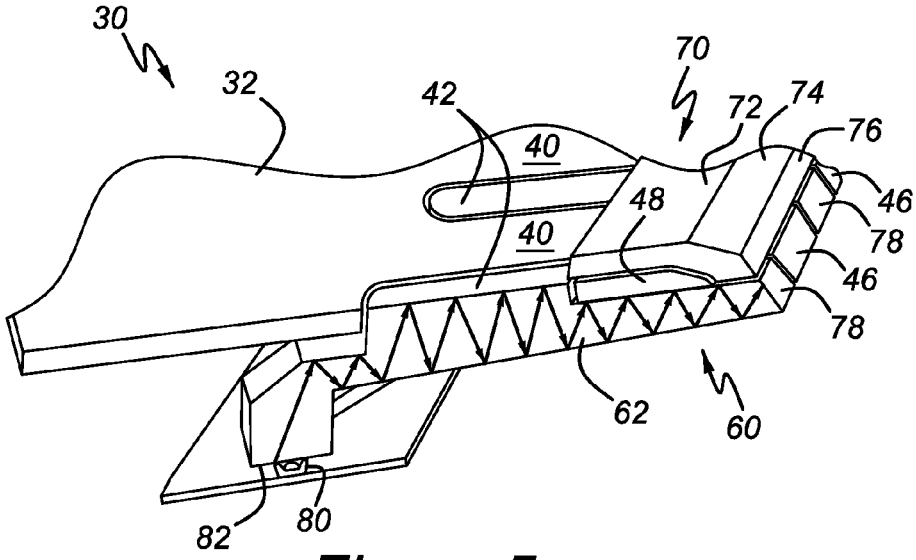
FIG. 5 is a perspective cross section through the bezel and a chrome surround showing a light guide and LED.

FIG. 5 is a perspective cross section through surface 32 and outboard stiffener 48 of the bezel 30. A chrome surround 70 having a bright outer surface overlaps the outboard stiffener 48. The chrome surround 70 is formed with an upper surface 72, a transition surface 74 and an inclined surface 76. When the chrome surround 70 is installed in headlamp assembly 10, the plane of the inclined surface 76 is substantially aligned with or parallel to the plane of the second surfaces 46 at the tip of each finger 40.

Similarly, when the light guide assembly 60 is installed in headlamp assembly 10, the plane of the inclined surfaces 78 is substantially aligned with or parallel to the plane of the inclined surfaces 46 at the tip of each finger 40 and the plane of the inclined surfaces 76 of the chrome surround 70.

Each of a series of semiconductor light sources 80, such as a light emitting diode (LED), is located at the entrance 82 of each of the light guides 62 of the light guide assembly 60 and at the entrance of each of the light guides 66 of the light guide assembly 64. Each of the light guides 62, 66 transmits light from the LED 80, such that light passes through one of the slots 42, 52 in first surfaces 32, and third surface 38, respectively, of bezel 30. Light transmitted through light guide assembly 60 also passes through each of the forward facing second inclined surfaces 78 of the light guide assembly 60.

Figure 6:
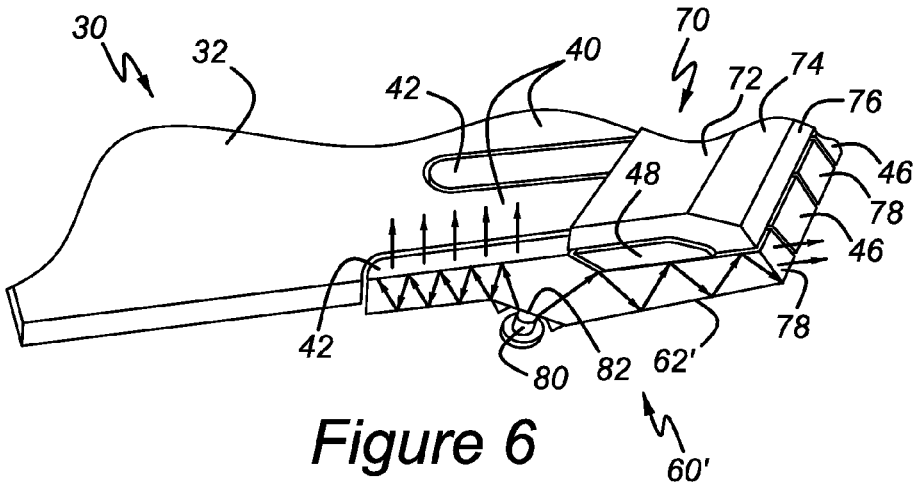
FIG. 6 is a perspective cross section through the bezel and a chrome surround an alternate light source location for a light guide.

In the cross section through the bezel 30, chrome surround 70 and light guide assembly 60' shown in FIG. 6, the LED 80 is located at an intermediate location along the length of the light guide 62'. Light from LED 80 is transmitted along light guide 62 in both directions, thereby providing light of more uniform intensity along the length of the light guide 62.

Figure 7:
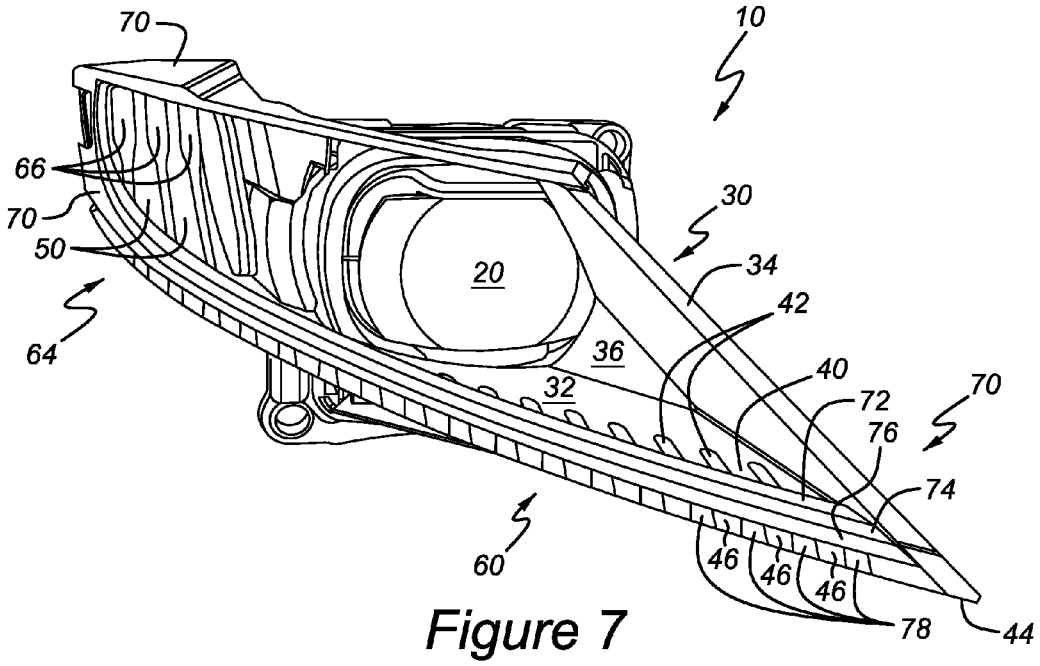
FIG. 7 is a perspective view of the assembled headlamp assembly of FIGS. 1 and 2.

FIG. 7 shows the assembled headlamp assembly 10 with the projector module 20 located in the assembly and supported on the body of the vehicle. The illuminated second inclined surfaces 78 of light guides 62 are distributed along the outboard periphery 44 of the bezel 30, the illuminated upper surfaces of light guides 62 are directed upward through the slots 42 in first surface 32 of bezel 30, and the illuminated inclined surfaces of second light guides 66 are visible through the slots 52 in inclined surface 38 of bezel 30. The chrome surround 70 overlaps the outboard stiffener 48 and extends along the upper, lower and lateral peripheries of the headlamp assembly 10. As FIG. 7 illustrates, the chrome surround 70 produces a structural connection between the inboard wall 34 and the upper edge of third surface 38, thereby providing structural continuity across the upper portion of the bezel 30.

In accordance with the provisions of the patent statutes, the preferred embodiment has been described. However, it should be noted that the alternate embodiments can be practiced otherwise than as specifically illustrated and described.

The invention claimed is:

1. A headlamp assembly, comprising:

a bezel disposed at an outer edge of the headlamp assembly and including a first surface having forward-directed first slots and forward-extending fingers under the first surface, wherein adjacent fingers are spaced mutually by respective second slots, and wherein a distal end of each finger includes a second surface inclined relative to the first surface, the bezel further comprises a third surface inclined upward and rearward with respect to the first surface, a second series of fingers separated by third slots, each third slot extending through the third surface;

a plurality of first light sources;

a plurality of first light guides, each light guide receiving light from a respective one of the first light sources, wherein each first light guide is fitted into a respective pair of first and second slots, each first light guide having a first light emitting surface disposed in the first slot and having a second light emitting surface disposed in the second slot between consecutive second surfaces;

a plurality of second light sources;

a plurality of second light guides, each second light guide fitted into one of the third slots, for transmitting light from one of the second light sources, along and through one of the third slots.

2. The headlamp assembly of claim 1, wherein each light source is a semiconductor light source.

3. The headlamp assembly of claim 1, further comprising a stiffener interconnecting the fingers, located near an outboard end of each finger, spanning the slots, and extending along an outboard periphery.

4. The headlamp assembly of claim 3, further comprising a surround that overlaps at least a portion of a length of the stiffener.

5. The headlamp assembly of claim 1, further comprising:

an inboard wall;

a member that connects the inboard wall and the third surface.

6. The headlamp assembly of claim 1, further comprising a side reflex.

7. The headlamp assembly of claim 1, further comprising a projector module that provides a primary source of light from the headlamp assembly.

8. A headlamp assembly, comprising:

a bezel disposed at an outer edge of the headlamp assembly and including a first surface having forward-directed first slots, and forward-extending fingers under the first surface, wherein adjacent fingers are spaced mutually respective second slots, and wherein an end of each finger includes a second surface inclined relative to the first surface and located at an outboard periphery, each first slot extending through the first surface, the bezel including a third surface inclined upward and rearward with respect to the first surface having a second series of fingers separated by third slots, each third slot extending through the third surface;

a plurality of light sources;

a plurality of light guides, each light guide receiving light from a respective one of the light sources, wherein each light guide is fitted into a respective pair of first and second slots, each light guide having a first light emitting surface disposed in the first slot and having a second light emitting surface disposed in the second slot between consecutive second surfaces;

second light guides, each light fitted into one of the third slots, for transmitting light from one of the light sources, along and through one of the third slots.

9. The headlamp assembly of claim 8, wherein each light source is a semiconductor light source.

10. The headlamp assembly of claim 8, further comprising a stiffener interconnecting the fingers, located near an outboard end of each finger, spanning the slots, and extending along said outboard periphery.

11. The headlamp assembly of claim 10, further comprising a surround that overlaps at least a portion of a length of the stiffener.

12. The headlamp assembly of claim 8, further comprising:

an inboard wall;

a member that connects the inboard wall and the third surface.

13. The headlamp assembly of claim 8, further comprising a side reflex.

14. The headlamp assembly of claim 8, further comprising a projector module that provides a primary source of light from the headlamp assembly.

* * * * *